United States Patent [19]

Giacone et al.

[11] 4,395,145

[45] Jul. 26, 1983

[54] SERIAL PRINTER

[75] Inventors: Felice Giacone, Giaveno; Raffaele Becchi; Boris Ukmar, both of Ivrea, all of Italy

[73] Assignee: Ing. C. Olivetti. & C., S.p.A., Italy

[21] Appl. No.: 267,911

[22] Filed: May 28, 1981

[30] Foreign Application Priority Data

Jun. 5, 1980 [IT] Italy ..... 67869 A80

[51] Int. Cl.[3] ..... B41J 1/24; B41J 19/20; B41J 11/20

[52] U.S. Cl. ..... 400/59; 400/144.2; 400/175; 400/320; 400/322

[58] Field of Search ..... 400/328, 320, 175, 56, 400/57, 59, 144.2, 144.3, 143, 144.1, 144, 162.1, 299, 320.1, 352, 354, 354.1, 683, 322

[56] References Cited

U.S. PATENT DOCUMENTS

| | | | |
|---|---|---|---|
| 772,057 | 11/1904 | Rice | 400/354.1 |
| 3,707,214 | 12/1972 | Ponzano | 400/144.2 |
| 4,049,109 | 9/1977 | Plaza et al. | 400/175 X |
| 4,063,630 | 12/1977 | Crowe et al. | 400/691 X |
| 4,178,106 | 12/1979 | Mailer et al. | 400/57 |
| 4,197,022 | 4/1980 | Dollenmayer | 400/144.2 |
| 4,203,680 | 5/1980 | Mitrovich | 400/144.2 X |
| 4,243,331 | 1/1981 | Savage et al. | 400/57 X |

FOREIGN PATENT DOCUMENTS

| | | | |
|---|---|---|---|
| 2838627 | 3/1979 | Fed. Rep. of Germany | 400/56 |

OTHER PUBLICATIONS

IBM Technical Disclosure Bulletin, vol. 8, No. 10, Mar. 1966, p. 1425, "Cord Tensioning Device" by Abbott et al.

Xerox Disclosure Journal, vol. 4, No. 2, Mar./Apr. 1979, pp. 179–180, "Carriage Design to Eliminate Left Cables" by Kockler.

*Primary Examiner*—Edgar S. Burr

*Attorney, Agent, or Firm*—Schuyler, Banner, Birch, McKie & Beckett

[57] ABSTRACT

A serial printer comprises a carriage 32 movable parallel to a platen 14 and on which there is mounted a printing device 31, for example of the daisy wheel type. The guides 23, 25 on which the carriage slide are mounted on a frame 20 which can turn with respect to the fixed sides of the machine on pivots 16, 17 to allow easy replacement of the daisy wheel. A motor 70 located beneath the roller constituting the platen effects displacement of the carriage along the writing line by means of a steel cable 72 and a series of return pulleys 44, 45, 75, 82. The cable passes through coaxial holes 74, 84 in the pivots of the frame, in such a way that its conditions are not altered when the frame is turned. A unidirectional clutch 86 and a spring 89 coupled to one end 88 of the cable maintain the tension in the cable always constant, while providing a non-yielding anchorage when the motor pulls on that end of the cable.

14 Claims, 7 Drawing Figures

SERIAL PRINTER

BACKGROUND OF THE INVENTION

The present invention relates to a serial printer comprising a platen rotatably mounted on a base, a carriage for supporting a printing device slidable on guides parallel to the platen, and a frame pivoted on the base of the machine and on which the guides are mounted.

A known serial printer comprises a printing unit carried by a carriage which slides transversely, along the length of the platen on a pair of guides, by means of a motor and a flexible cable for connection between the motor and the carriage. The guides on which the carriage slides are carried by a frame pivoted in a projecting manner on two lateral tongues of one end, on a relatively short fixed shaft which lies in a plane orthogonal to the platen. In the working position the frame is coupled to a side of the base and the guides lie parallel to the platen. By manually rotating it with respect to the shaft on which it is pivoted, the frame can be spaced from the other end of the platen in such a way that the user can gain access to the rear part of the printing device and the carriage for maintenance. This printer has the disadvantage of occupying considerable space when the frame is open and of not being suitable for accepting a keyboard or a control console in front of it. Moreover, the projection of the frame with respect to the base, and the weight of the motor, the carriage and the frame itself requires a very heavy structure the weight of which is borne on the pin and makes it subject to significant wear. A second disadvantage lies in the fact that the connection cable between the carriage and the motor and the various pulleys are subjected to wear which varies the geometric conditions between the parts so that the tension of the cable requires periodic adjustment.

SUMMARY OF THE INVENTION

The object of the present invention is to provide a serial printer in which the frame on which the transverse carriage guides are mounted can be easily displaced with respect to the base to permit maintenance of the printing device, and which will be simple and reliable.

In accordance with this object, and for avoiding other disadvantages of the known printer, the frame of the serial printer according to the invention has two lateral pivots which lie adjacent to the lateral ends of the parallel guides on an axis parallel to the platen, in such a way that the guides can swing about this axis whilst remaining constantly parallel to the platen.

A second object of the present invention is that of providing a fast serial printer in which the geometric conditions between the parts connecting the motor and the carriage remain constant, and in which the flexible cable which connects the carriage to the motor is always subject to a predetermined constant tension.

In accordance with this second object, the cable which connects the carriage to the motor, in the printer according to the invention, is tensioned at one end by a spring with the interposition of a unidirectional clutch providing automatic take-up of any play in one direction and a substantially positive anchorage in the opposite direction.

BRIEF DESCRIPTION OF THE DRAWINGS

The present invention will now be described with reference to the accompanying drawings, in which.

DETAILED DESCRIPTION OF A PREFERRED EMBODIMENT

Figure 1:
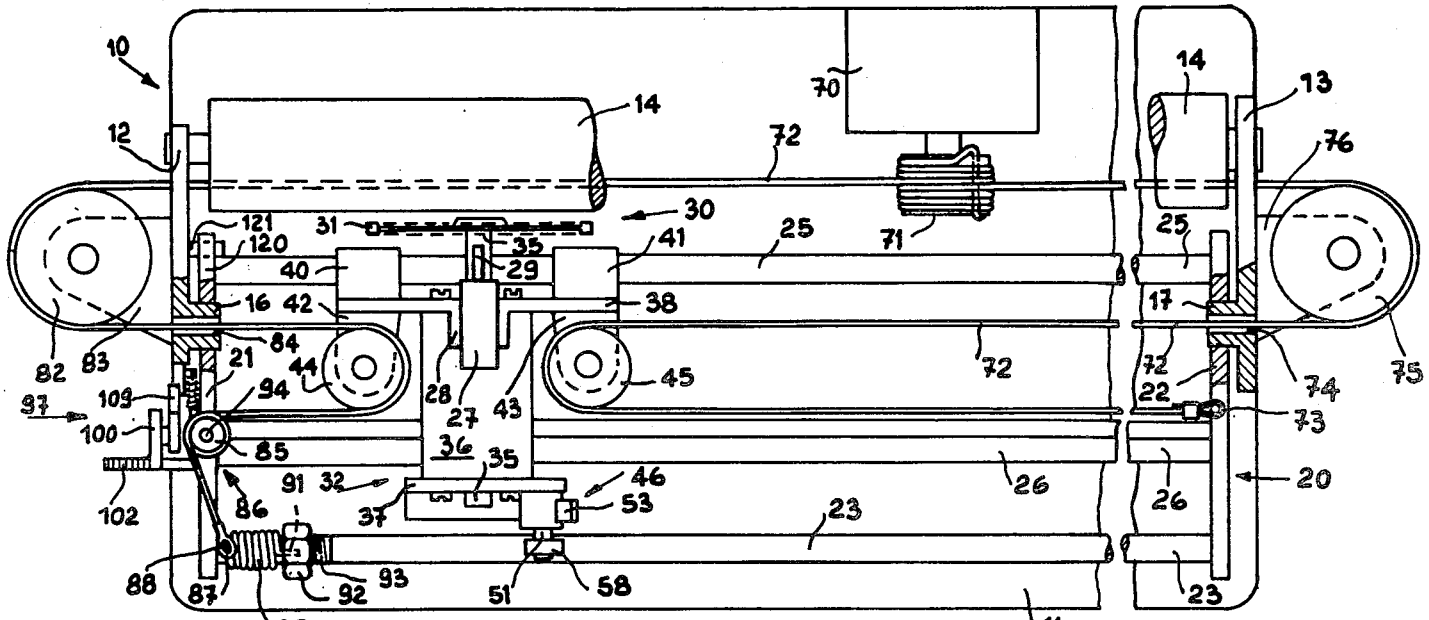
FIG. 1 is a partially sectioned plan view of a serial printer embodying the invention.

Referring now to FIG. 1, the serial printer 10 according to the invention comprises a base 11 having two lateral sides 12,13 between which there is rotatably mounted a platen roller 14.

On two pivots 16,17 of the sides 12,13, coaxial with a single axis parallel to the platen 14, there is pivoted a frame 20 comprising two sides 21,22 parallel to the fixed sides 12,13, two cylindrical guides 23 and 25, parallel to the platen 14, and a central bar 26 of substantially square section. A printing device 30, including for example a character-carrying disc 31 of flexible blades, of the type described in U.S. Pat. No. 4,236,838 issued on Dec. 2, 1980 and assigned to the same assignee as the present application, is mounted on a carriage 32 slidable on the guides 23 and 25 parallel to the platen 14. The disc 31 is mounted on a shaft 35 of an electric selector motor 36, for example a stepping motor.

The carriage 32 (FIGS. 1 and 2) includes a front flange 37 and a rear flange 38, between which the motor 36 is arranged. On a front tongue 28 of the flange 38 there is mounted an electro-magnet 27 which controls a striker hammer 29 located in front of the character-carrying blade selected for the printing of the desired character. The striker 29 and the electro-magnet 27 are of known type and will not be described in detail here. The flange 38 carries at the front two horizontal tongues 42 and 43 on which are pivoted two pulleys 44 and 45 respectively. Finally, on the rear part of the flange 38, there are fixed two bushes 40 and 41 for the sliding of the carriage on the guide 25. The front flange 37, (FIG. 3) supports a mechanism 46 for the manual adjustment of the distance of the character-carrying disc 31 from the platen 14. The mechanism 46 includes a lateral tongue 47 of the flange 37 (FIG. 3) provided with a bush 48 (FIGS. 2 and 3) having a central through hole 49 parallel to the shaft 35 of the motor 36.

Within the hole 49 there is positioned a pivot pin 50 having an eccentric end portion 51. To the pin 50 there is fixed a lever 52 provided with a knob 53 and a resilient tongue 54 having a wedge shape end 56 normally engaged in one notch of a series of notches 57 formed in an edge of the tongue 47. On the end 51 of the pivot pin 50 there is rotatably mounted a ball bearing 58 slidable on the guide 23.

A ball bearing 62, also slidable on the guide 23 and counterposed with respect to the bearing 58, is mounted on a lever 60 which is also pivoted on the bush 48. A spring 64 stretched between the lever 60 and the flange 37 holds the two bearings 58 and 62 constantly in contact with the guide 23.

To control the displacement of the carriage 32 (FIG. 1) in front of the platen 14, there is provided a bidirectional motor 70 (FIGS. 1 and 2) mounted on the base under the platen 14 in a median zone of the printer 10. The motor 70 carries a drum 71 over which there is partially wound a central section of a flexible cable 72, for example of steel. One branch of the cable 72 has a first end 73 fixed on the side 22 of the frame 20; this branch of the cable 72 passes over the pulley 45 of the carriage 32, traverses a through hole 74 coaxial with the pivot 17 of the side 13, passes over a pulley 75 rotatably mounted on horizontal tongue 76 of the side 13 and is wound helically, from a central part towards an outer end 77 (FIG. 4) on the drum 71. From the end 77 the cable 72 passes through an axial hole 78 formed in the periphery of the drum 71 and emerges from an inner end 79. The other branch of the cable 72 is helically wound from the inner end 79 as far as the central part of the drum 71 in the same sense as the first branch. This other branch of the cable 72 passes over a pulley 82 (FIG. 1) rotatably mounted on a horizontal tongue 83 of the side 12, traverses a through hole 84 coaxial with the pivot 16 of the side 12, and passes over the pulley 44 of the carriage 32. From here the cable 72 is helically wound on a rotatable part 85 (FIGS. 1 and 2) of a uni-directional friction clutch 86, and a second end 87 is fixed to a hook 88 of a helical spring 89 wound on the guide 23 close to the side 21 of the frame 20. One end 91 of the spring 89 is connected to an adjustment nut 92 screwed on a threaded part 93 of the guide 23, which allows both the tension and the length of the cable 72 emerging from the clutch 86 to be adjusted.

Figure 7:
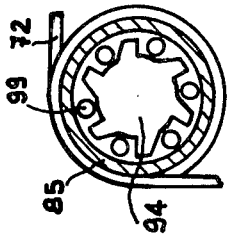
FIG. 7 is a sectioned plan view of a further detail of the printer of FIG. 1.

The uni-directional friction clutch 86 is of known type, and includes a central cylindrical stem 94 shaped as illustrated in FIG. 7, which is fixed to the side 21 of the frame 20 and with respect to which the rotatable part 85 can turn only in the anti-clockwise sense (FIGS. 1 and 7), due to the presence of balls 99 between the stem 94 and the part 85. The drum 71 (FIG. 4) is provided with a helical groove 95 formed on its periphery in order better to receive the cable 72. The development of the groove 95 is greater than twice the path of the carriage 32 in front of the platen 14 in such a way as to leave turns of the cable 72 still wound on the drum 71 when the carriage is positioned at the two ends of the printing line.

Figure 2:
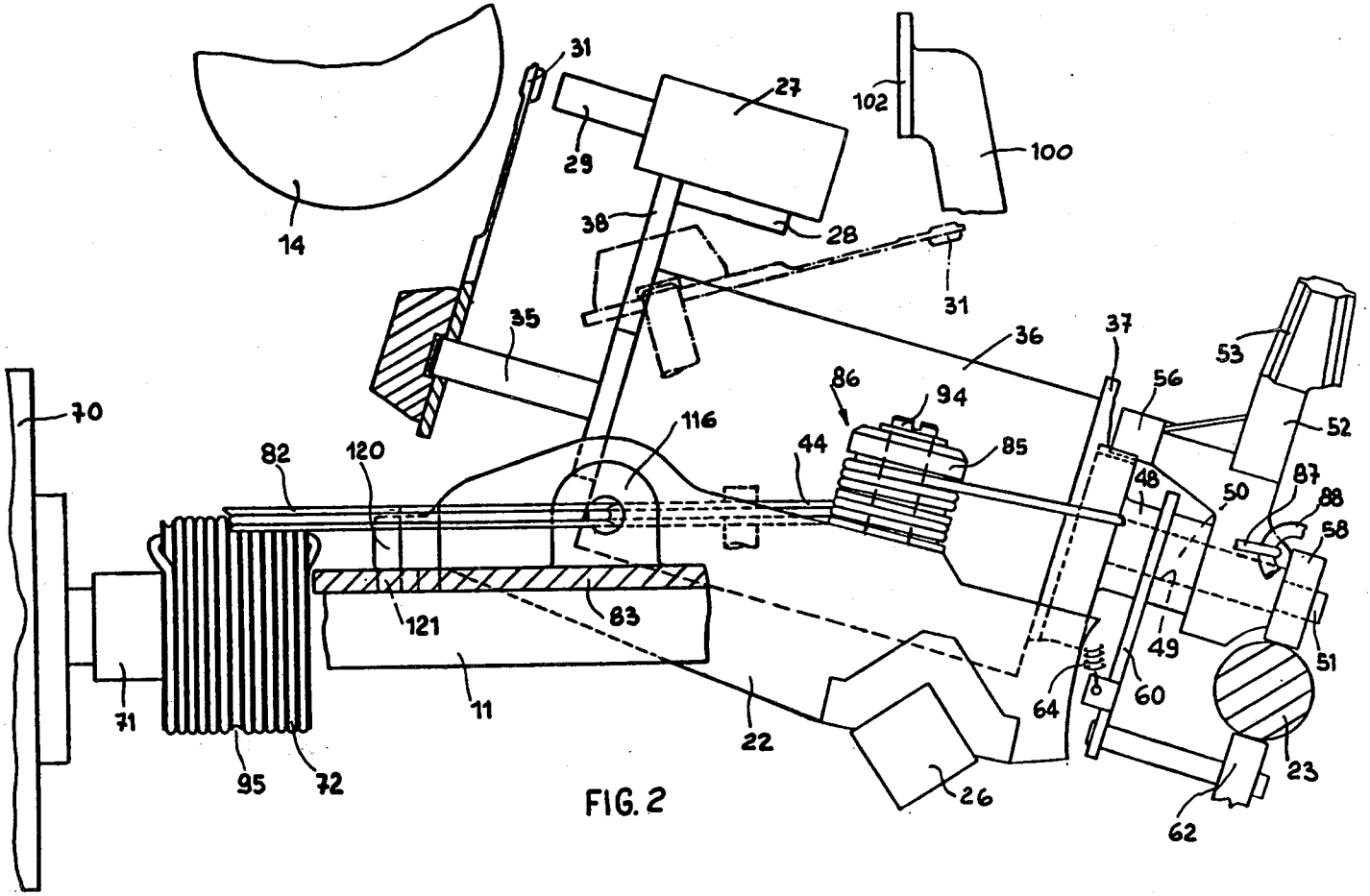
FIG. 2 is a first left hand side view, partially sectioned, which shows various details of the serial printer of FIG. 1.
Figure 3:
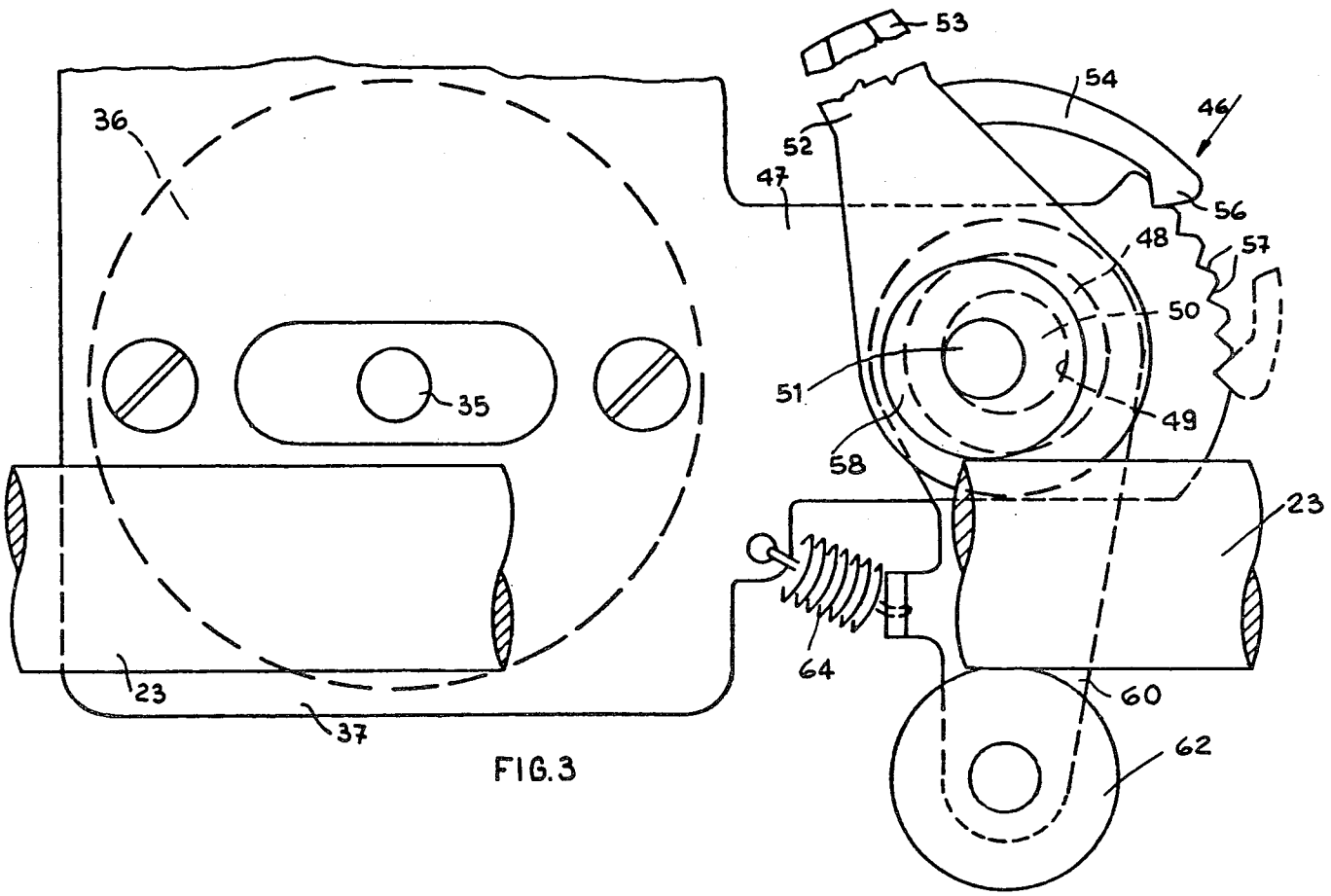
FIG. 3 is a partially sectioned front view of various details of FIG. 2.

The frame 20 (FIG. 1), being pivoted on pivots 16 and 17, can rotate with respect to the fixed sides 12 and 13. A manually operable mechanism 97 (FIG. 5) is provided for effecting such rotation. The mechanism 97 includes a bridge type lever 100 which is pivoted on a cylindrical end 101 of the bar 26 of the frame 20 and has a knob 102 (FIG. 1) at its upper end. A lever 100 is constantly urged towards the platen 14 by a spring 103 (FIG. 5) stretched between a fixed pin 104 of the side 12 and a tongue 105 of the lever 100 itself. In the rest condition the spring 103 pulls a rear end 120 of the frame 20 into abutment against a fixed stop 121 of the side 12 (FIGS. 1 and 2). In this position the shaft 95 of the motor 36 is substantially horizontal and the character disc 31 is substantially vertical, with the upper blade located in front of the printing line on the platen 14. A peg 107 (FIG. 5) of the frame 20 limits the rotation of the lever 100 in the anti-clockwise sense. On the cylindrical end 101 there is also pivoted a hook lever 108 provided with a tooth 109 which in the rest position is hooked over an upper edg 110 of a small plate 111 fixed to the side 12. A spring 112, tensioned between an end 113 of the lever 100 and an end 114 of the lever 108 tends to make this latter turn in an anti-clockwise sense. The lever 108 is also provided with a pin 115 which can cooperate with a side 116 of the tongue 105. The small plate 111 has a curved edge 118 which can cooperate with the tooth 109 of the lever 108.

The operation of the serial printer described hereinabove is as follows.

In rest conditions, the frame 20 is located in the position illustrated in FIGS. 1 and 2, that is to say with the guides 23 and 25 lying in a plane inclined by 17° with respect to the horizontal plane. In this position the character-carrying disc 31 has its blades located in an almost vertical plane ready for effecting printing of a character upon operation of the striker hammer 29.

The distance of the printing unit 30 from the platen 14 is easily adjustable by means of the mechanism 46. In fact, by manually turning the lever 52 (FIG. 3) in a clockwise sense, the pin 50 also turns in the same sense raising the eccentric end 51 on which the bearing 58 is mounted. Consequently the flange 37 is lowered and the entire carriage 32 turns in a clockwise sense (FIG. 2) with respect to the guide 25, thus carrying the upper blades of the disc 31 a greater distance from the platen 14. Similarly, by turning the lever 52 in an anti-clockwise sense (FIG. 3) the disc 31 is brought closer to the platen 14. In both cases the spring 64 ensures a constant contact of the bearings 58 and 62 on the front guide 23. The eccentricity of the part 51 with respect to the pin 50 is such that by displacing the resilient tongue 54 together with the lever 52 from one notch 57 to the adjacent notch, the distance of the character-carrying blade is adjusted by 0.1 mm.

The movement of the carriage 32 on the guides 23 and 25 (FIG. 1) is effected by the motor 70 via the cable 72. The carriage 32 is displaced from right to left when the drum 71 turns in the clockwise sense (FIG. 4), whilst it moves from left to right when, on the other hand, the drum 71 turns in the anti-clockwise sense.

When the printer is at rest the tension of the cable 72 (FIG. 1) along the whole of its length from the end 73 to the end 87 is maintained constant by the spring 89. This spring also prevents the branch of the cable 72 which runs from the drum 71 to the pulley 44 from becoming slack during translation movements of the carriage 32 in which this branch is not being pulled. The uni-directional clutch 86 represents, on the other hand, a rigid anchorage when the motor 70 accelerates the carriage during its movement from right to left, or rather when it brakes the carriage in its displacement from left to right putting maximum strain on the branch of the cable 72 which runs from the drum 71 to the pulley 44.

Since the other branch of the cable 72 is rigidly anchored to the frame the two branches of the cable 72 are only subjected to the very limited resilient deformations due to the pull applied by the motor 70. The rigidity of the transmission from the motor to the carriage is very high and entirely independent of the yielding of the spring 89. This ensures a rapid response of the interconnection system with the motor 70 and a limited oscillation of the carriage with respect to the stopping positions.

Figure 5:
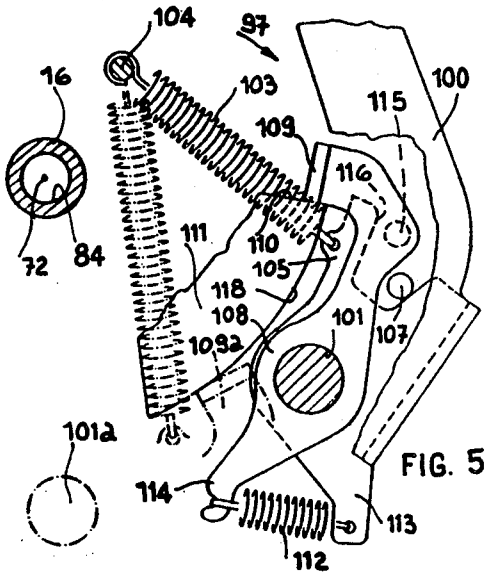
FIG. 5 is a second left side view, partially sectioned, which shows other details of the serial printer of FIG. 1.
Figure 4:
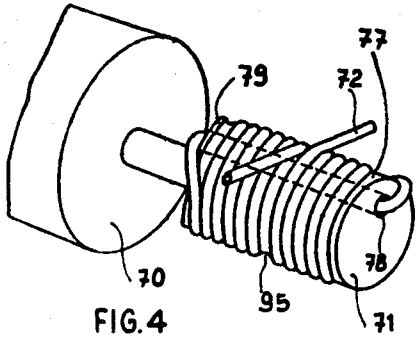
FIG. 4 is a perspective view on an enlarged scale of a first detail of the serial printer of FIG. 1.

During the adjustment of the printer necessary upon setting up, the spring 89 tensions the whole of the cable 72 which, during setting up, can become slack, including the region of the cable 72 lodged within the hole 78 of the drum 71 (FIG. 4). Having positioned the carriage in its zero position one then proceeds to define the zero of the linkage system of the motor 70 for a correct position of the carriage 32 with respect to the platen 14 in a known manner which is not described in detail. When it is required to gain access to the character-carrying disc 31 mounted on the shaft 35, for example to replace it with another, the frame 20 is turned with respect to the fixed pivots 16 and 17 by manually operating the mechanism 97 (FIGS. 1 and 5). This operation can be effected independently of the position of the carriage 32 along the guides 23 and 25.

The lever 100 is turned in a clockwise sense (FIG. 5) against the action of the spring 103 until the side 116 of its tongue 105 comes into contact with the pin 115 of the lever 108. After this, by continuing to turn the lever 100 in the clockwise sense the lever 108 is also turned in the same sense against the action of the spring 112, and its tooth 109 becomes uncoupled from the upper edge 110 of the small plate 111. This clockwise rotation of the levers 100 and 108 continues until the side 116 abuts against the peg 107 fixed on the side 21 of the frame 20.

By pressing the lever 100 downwardly the whole frame 20 is now turned with respect to the pins 16 and 17 until the pin 101, coaxial with the bar 26, is carried into the position illustrated in broken lines in FIG. 5 and indicated 101*a*. In this new position the tooth 109 is located in the position shown in broken outline and indicated 109*a*. Moreover, the pin 101 and the bar 26 being located almost under the pins 16 and 17, the guides 25 and 23 lie in a substantially horizontal plane. In this position the character-carrying disc 31 is spaced from the platen and is easily accessible by the operator; this position is illustrated in broken outline in FIG. 2.

The cable 72, during the rotation of the frame 20 on its pins 16 and 17 (FIG. 1) does not change its adjustment and is only subjected to a negligible additional tension due to the torsion in the section lying between the pulley 44 and the pulley 82 and in the section lying between the pulley 45 and the pulley 75.

To return the frame 20 into its rest position it is only necessary to raise the lever 100 until, by the effect of the springs 103 and 112, the hook 109 disengages from the edge 110 of the plate 111 (FIG. 5). This takes place when the rear end 120 of the side 21 (FIGS. 1 and 2) is carried back into contact with the fixed stop 121.

Figure 6:
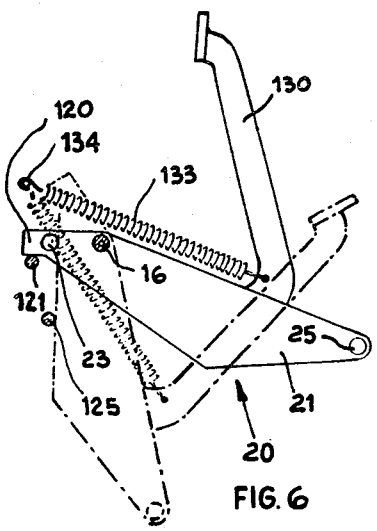
FIG. 6 is a left side view of a variant of the serial printer according to the invention.

In a variant, illustrated in FIG. 6, the mechanism 97 comprises a lever 130 fixed to the side 21 of the frame 20 in a zone intermediate between the pin 16 and the guide 25, and a spring 133 which connects the lever 130 to a point 134 on the fixed side 12. The spring 134, in the rest condition, holds the frame 20 with its end 120 abutting against the stop 121.

By lowering the lever 130 the frame 20 is made to turn in the clockwise sense about the pin 16 until the side 21 stops against a second peg 125 fixed to the side 12. In this condition, illustrated in broken outline in FIG. 6, the spring 133 stably holds the frame 20 in its new position.

From the above description it will be clear that the printing device 30 is mounted on a carriage 32 slidable on guides 23 and 25 parallel to the platen 14 and mounted on a frame 20 pivoted on the base 11, and that the pivots 16 and 17 for the frame 20 lie on an axis parallel to the platen 14 in such a way that the frame 20 can turn on the pivots 16 and 17 whilst remaining parallel to the platen 14.

It will also be clear that a bidirectional motor 70 controls the displacement of the carriage 32 along the guides 23 and 25 by means of a flexible cable 72, that this cable 72 has a first end 73 fixed with respect to the guides, a central part wound on the shaft 71 of the motor 70, and a second end 87 connected to a tension spring 89, and that this cable 72, at its second end 87, is connected to a uni-directional clutch 86.

For example, in place of a single flexible cable 72 there could be used two cables which may be connected at one end to the carriage 32 and at the other to the drum 71 of the motor 70. Moreover, the printing device 30 rather than being of the character disc type can be of wire printing, each wire being operated by a corresponding selector electro-magnet, as described in U.S. Pat. No. 4,010,836 issued on Mar. 8, 1977 and assigned to the same assignee of the present invention.

What we claim is:

1. A serial printer comprising a base, a platen mounted on said base, a frame pivoted on said base and including guides parallel to said platen, a carriage slideable on said guides and a printing device mounted on said carriage, wherein said frame has two lateral pivots which lie adjacent to the lateral ends of said guides on an axis parallel to said platen in such a way that said guides can swing about said axis while remaining constantly parallel to said platen, wherein a motor mounted on said base controls the displacement of said carriage along said guides by means of a flexible connection cable, wherein a coaxial hole is provided in each one of said lateral pivots of said frame and wherein said flexible cable passes through the coaxial hole of said pivots.

2. A printer according to claim 1, wherein said motor is bidirectional, and has a drum mounted on its shaft, wherein said cable has a central part wound on said motor drum and two runs maintained rectilinearly in a section lying between said pivots by a first pair of pulleys mounted on said base, and wherein said pulleys guide said cable from said rectilinear section to said central part.

3. A printer according to claim 2, wherein said cable has its two ends fixed on anchorage parts of said frame and wherein a second pair of pulleys mounted on said carriage guide the runs of said cable from said rectilinear section to the anchorage parts of the frame.

4. A printer according to claim 1, wherein said flexible cable has a first end fixed with respect to said frame, a central part wound on a shaft of said motor, and a second end tensioned by a spring with the interposition of a uni-directional clutch for automatically taking up any play in one direction and providing a substantially positive anchorage in the opposite direction.

5. A printer according to claim 1, wherein said printing device includes a character disc positioned in front of said platen, a selector motor for the selection of the characters of the said disc, wherein said carriage comprises a front flange provided with a first slidable element on a first of said parallel guides and a rear flange provided with a second element slidable on a second of said parallel guides, and wherein said selector motor is mounted between said two flanges.

6. A printer according to claim 5, wherein said character disc is mounted behind said rear flange on a shaft of said selector motor, and wherein an adjusting mechanism is mounted on said front flange for adjusting the angle of the axis of the shaft of said selector motor with respect to the plane in which said guides lie whereby adjusting the distance of said character disc from said platen.

7. A printer according to claim 6, wherein said mechanism comprises a pivot pin rotatably mounted on said front flange parallel to the axis of said motor shaft, an eccentric end of said pivot pin on which said first slidable element is mounted, and a lever connected to said pin for adjusting the eccentricity of said end with respect to said motor shaft.

8. A printer according to claim 7, wherein said lever comprises a tooth engageable with a plurality of fixed notches and the displacement of said tooth of said lever from one to the adjacent of said fixed notches corresponds to the approach or separation of said character disc by 0.1 mm with respect to said platen.

9. A printer according to claim 1, wherein said printing device comprises a character disc positioned in front of said platen, and wherein said frame is turnable between a first position in which said disc is substantially vertical and near to said platen, and a second position in which said disc is substantially horizontal and spaced from said platen.

10. A device according to claim 9, wherein a single spring stretched between a fixed point on said base and a side of said frame holds said frame in said first and second positions.

11. A serial printer comprising a platen, two guides parallel to said platen, a carriage slideable on said two guides, a printing device mounted on said carriage, a bidirectional motor shaft for controlling the displacement of said carriage along said two guides, a helical spring wound on a support shaft fixed with respect to said two guides, a single flexible cable which connects said motor shaft to said carriage, said cable having a first end fixed with respect to said two guides, a central part wound on said motor shaft, a second end fixed to a first extremity of said helical spring, and a portion intermediate between said second end and said central part, a friction clutch on which is wound the intermediate portion of said cable, and means for allowing adjustment of the tension force and of the length of said flexible cable, said adjustment allowing means comprising an adjustment nut screwed on a threaded part of said support shaft and connected to a second extremity of said helical spring.

12. A serial printer according to claim 11, wherein said friction clutch is of unidirectional type for automatically taking up any play in the direction of the tension force applied by said helical spring and for acting as a substantially positive anchorage in the opposite direction.

13. A serial printer according to claim 11, wherein said support shaft is constituted by an end of one of said two guides.

14. A serial printer according to claim 13, further comprising a side wall supporting said end of one of said two guides and an end of the other guide wherein said spring is located between said side wall and said nut, and wherein said friction clutch is supported by said side wall.

* * * * *